United States Patent [19]

Habich et al.

[11] 4,215,945

[45] Aug. 5, 1980

[54] PAPER FEEDING APPARATUS

[75] Inventors: Adolph B. Habich; Ronald E. Hunt, both of Austin, Tex.

[73] Assignee: International Business Machines Corporation, Armonk, N.Y.

[21] Appl. No.: 973,361

[22] Filed: Dec. 26, 1978

[51] Int. Cl.[3] ..... B41J 13/04

[52] U.S. Cl. ..... 400/636; 400/630; 400/637.2; 400/637.6; 400/639.1; 400/637.4

[58] Field of Search ..... 400/636, 636.1, 636.2, 400/630, 631, 637, 637.1, 637.2, 637.4, 637.5, 637.6, 639.1, 639.2, 645, 647.1, 670.3, 663

[56] References Cited

U.S. PATENT DOCUMENTS

| | | | |
|---|---|---|---|
| 1,145,017 | 7/1915 | Hess | 400/637.2 X |
| 1,376,879 | 5/1921 | Holden | 400/637.4 |
| 1,444,385 | 2/1923 | Phelps | 400/637.4 X |
| 1,841,116 | 1/1932 | Garbell | 400/637.5 |
| 1,874,256 | 8/1932 | Dobson | 400/637.3 X |
| 1,955,578 | 4/1934 | Crumrine | 400/637.2 |
| 1,969,773 | 8/1934 | Avery | 400/637.2 |
| 2,057,981 | 10/1936 | Rowland et al. | 400/637.2 X |
| 3,223,221 | 12/1965 | Arthur | 400/637.4 X |

OTHER PUBLICATIONS

"Antitreeing Device for Paper Feed Mechanisms" IBM Tech. Discl. Bulletin, vol. 15, No. 7, Dec. 1972, p. 2311.

"Paper Feed" IBM Tech. Discl. Bulletin, vol. 18, No. 5, Oct. 1975, pp. 1305–1306.

"Document Entry Mechanism for Typewriter Paper Handler", IBM Tech. Discl. Bulletin, vol. 21, Jul. 1978, pp. 709–710.

"Paper Table Actuated Feed Rollers & Paper Gate" IBM Tech. Discl. Bulletin, vol. 17, No. 5, Oct. 1974, pp. 1263–1264.

*Primary Examiner*—Eugene H. Eickholt

*Attorney, Agent, or Firm*—James H. Barksdale, Jr.

[57] ABSTRACT

Apparatus for facilitating printer paper feeding. The apparatus is made up of a yoke and a platen channel carrying a paper aligner and feed rollers. The yoke has downwardly extending legs with a detent therebetween. The apparatus is rotatably positionable on a rod mounted parallel to the platen, and the detent is for accepting the rod. The downwardly extending legs are for cooperating with a tooth of a rotatable comb for causing rotation of the apparatus on the rod. The channel serves as a paper deflector and guide for guiding paper about the platen. Within the channel are openings through which front and rear feed rollers carried by the channel extend. Also within the channel is an aligner opening for accepting the paper aligner which is positionable within the aligner opening. The paper aligner has a downwardly extending leg for cooperating with another tooth on the comb to position the aligner within the aligner opening. Due to the structure of the apparatus, a member thereof can be utilized and positioned on the rod to accommodate any length platen.

10 Claims, 6 Drawing Figures

PAPER FEEDING APPARATUS

CROSS-REFERENCE TO RELATED APPLICATION

U.S. patent application Ser. No. 973,360, filed Dec. 26, 1978, entitled "Paper Feeding Control Apparatus", and having R. E. Hunt et al. as inventors.

BACKGROUND OF THE INVENTION

1. Field of the Invention

This invention relates generally to printer paper handling. More specifically, this invention relates to apparatus for facilitating the feeding of paper about a platen.

2. Description of the Prior Art

Representative of typical prior art related to this invention are IBM Technical Disclosure Bulletins Vol. 15, No. 7, December 1972, page 2311; Vol. 17, No. 5, October 1974, pages 1263 and 1264; Vol. 18, No. 5, October 1975, pages 1305 and 1306; and Vol. 21, No. 2, July 1978, pages 709 and 710.

Illustrated in various ones of these prior art publications are the general features of paper deflecting, front and rear roller feeding, and paper aligning. Each of these features taken alone, or in combination, is old and well known. Also well known is a plurality of individually actuatable and independently suspended rollers for maintaining a uniform driving contact between paper and the platen. Absent from the prior art though, is a single modular unit embodying all of the above general features. Also absent is a modular unit which (1) is to be carried and operated on a single shaft or rod, (2) can be operated to provide all desired functions by one rotatable means, (3) is structured to be readily installed and which reduces printer assembly costs, and (4) can be used in combination with a number of other of the modular units mounted on the same rod and operated by the same means to accommodate any length platen. In addition, when single modular units are utilized, there is a reduction in supporting and cooperating structure and costs, and improved results.

SUMMARY OF THE INVENTION

Apparatus is provided for facilitating paper feeding about a printer platen, and reducing printer assembly costs. Costs are reduced since the apparatus is structured to be installed in one simple snap-on operation during printer assembly. The apparatus is comprised of a yoke and a platen channel carrying a paper aligner and feed rollers. The channel is for cooperating with the platen to deflect and guide paper when inserted into the printer and fed about the platen. The yoke is connected to the channel and has downwardly extending legs with a detent therebetween. The apparatus is rotatably positionable on a rod mounted parallel to the platen. The detent is for accepting the rod. The downwardly extending legs cooperate with a tooth on a rotatable comb to effect rotation of the apparatus about the rod. Within the channel are openings through which front and rear feed rollers carried by the channel extend. Also within the channel is an opening for accepting a positionable paper aligner carried by the channel. The paper aligner normally extends through the aligner opening and is biased in engagement with the platen. The paper aligner has a downwardly extending leg for cooperating with another tooth on the comb. The yoke legs and aligner leg are contacted at different times by the comb teeth upon different extents and directions of rotation of the comb. At the time of initial insertion of paper into the printer from the rear of the platen, the comb must have already been rotated in a forward direction toward an operator for maintaining the rear feed roller out of engagement with the platen. When the rear feed roller is out of engagement with the platen, the front feed roller will be in engagement with the platen. Since the paper aligner will be in engagement with the platen at this time, the operator can align the leading edge of the paper against the paper aligner. Thereafter, the comb is rotated in a reverse direction. The first extent of rotation of the comb in the reverse direction permits rotation of the apparatus about the rod and translation of the front feed roller away from the platen. Continued rotation of the comb a second extent causes translation of the rear feed roller toward the platen for obtaining positive engagement between the paper and platen. Further rotation of the comb in the same direction a third extent causes the paper aligner to be withdrawn or repositioned out of the path of the paper. The paper can now be driven about the platen upon rotation of the platen. After the leading edge of the paper has been driven past the paper aligner and front feed roller to a first writing line position, the comb is again rotated in the forward direction. The first extent of forward rotation of the comb permits restoration of the paper aligner. At this time the paper aligner will be biasing the paper against the platen. This results in the paper being held in place while the rear feed roller is translated away from the platen during a second extent of forward rotation of the comb. Rotation of the comb in the forward direction a third extent results in the front feed roller being translated toward the platen. Upon engagement of the front feed roller and the paper, the paper is forced into engagement with the platen. The paper is now ready to be printed. During printing, the platen is incrementally rotated for indexing between lines to be printed.

DESCRIPTION OF THE PREFERRED EMBODIMENT

GENERAL OPERATIONAL DESCRIPTION

As pointed out above, apparatus utilized for facilitating the feeding of paper about a platen in a printer generally includes a paper deflector, a rear feed roller, a paper aligner, and a front feed roller. The front feed roller is the roller closest to an operator when facing the printer. Prior to an initial loading operation wherein a sheet of paper is to be inserted into the printer from behind the platen, the rear feed roller is sufficiently displaced from the platen to permit the leading edge of the sheet of paper to be inserted between the rear feed roller and the platen. The paper deflector extends into the path of the leading edge to guide the paper between the rear feed roller and the platen. At this time, the paper aligner is in engagement with the platen. The paper aligner is for engaging the leading edge of the paper as it is inserted into the printer for aligning the paper. Following alignment of the paper, the rear feed roller is translated toward the platen for causing positive engagement between the platen and the paper. Prior to rotating the platen for feeding the paper between the rear feed roller and platen and about the platen, the paper aligner is brought out of the path of the leading edge of the paper. Also, the front feed roller must be out of engagement with the platen to provide an unobstructed path for the paper about the platen. Thereafter, the platen is rotated until the leading edge is fed beyond the paper aligner and front feed roller. After the paper has been fed to this extent, the front feed roller is translated toward the platen for providing positive engagement between the platen and the paper for continued feeding or indexing of the paper.

SPECIFIC STRUCTURAL DESCRIPTION

Figure 1:
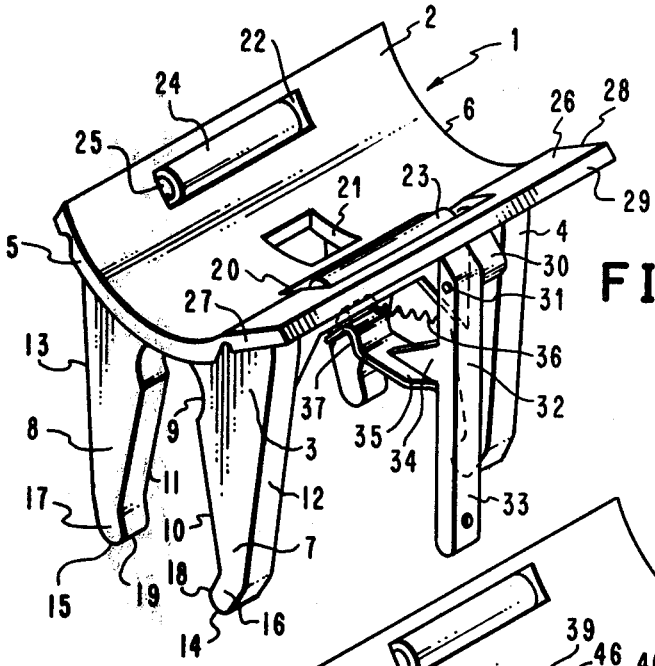
FIG. 1 is a perspective view of the apparatus of this invention with the paper aligner withdrawn to permit feeding of an aligned sheet of paper.
Figure 3:
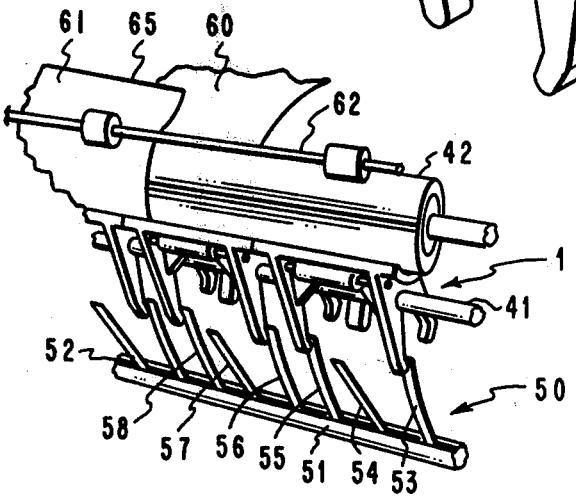
FIG. 3 is a perspective view of a portion of a printer and illustrates the relationship of the apparatus of this invention to the printer platen, and the comb utilized for controlling the apparatus.

Referring first to FIG. 1, there is shown the apparatus of this invention generally designated by reference numeral 1. The greater portion of apparatus 1 is made up of a one piece molded saddle having an arcuate shaped channel 2 and integral yokes 3 and 4. Yokes 3 and 4 are identical. Yoke 3 is located on the bottom of channel 2 adjacent end 5 and yoke 4 is located on the bottom of channel 2 adjacent end 6. Although only one of yokes 3 and 4 will suffice, both are provided to reduce the possibility of apparatus 1 skewing during rotation thereof about a circular rod or shaft 41 (FIG. 3). Skewing will result in non-uniform engagement between a sheet of paper 60 and a printer platen 42 (FIG. 3). Since yokes 3 and 4 are identical, only yoke 3 will be described in detail. Yoke 3 has downwardly extending legs 7 and 8 with a detent 9 therebetween adjacent channel 2. Detent 9 is circular in shape and terminates with inner divergent surfaces 10 and 11 of legs 7 and 8. Circular detent 9 has a wrap slightly greater than 180°. Apparatus 1 is comprised of a relatively rigid polymeric material. The material is sufficiently resilient with respect to the degree of wrap of detent 9 though, for legs 7 and 8 to be expanded for snapping apparatus 1 on shaft 41 (FIG. 3). When apparatus 1 is installed on shaft 41, shaft 41 is positioned in detent 9. Apparatus 1 is releasably maintained on shaft 41 by the degree of wrap of detent 9.

The outer surfaces 12 and 13 of legs 7 and 8 converge toward bottoms 14 and 15. The lower extremities 16 and 17 of legs 7 and 8 converge toward one another as shown. The inner surfaces 18 and 19 of extremities 16 and 17 are for cooperating with means for rocking or rotating apparatus 1 on shaft 41 as will be described in greater detail later herein.

Within channel 2 are three openings. Opening 20 is for accommodating a rear feed roller 23, opening 21 is for accommodating a paper aligner generally designated by reference numeral 45 in FIG. 2, and opening 22 is for accommodating a front feed roller 24. Front feed roller 24 is rotatable about a shaft 25 journaled in yokes 3 and 4 below channel 2. Rear feed roller 23 is rotatable about a shaft 44 (FIG. 4) journaled in the upper portion of yokes 3 and 4 below channel 2. A portion of opening 20 exists within the arcuate portion of channel 2 and the remainder thereof is located within an angularly extending lip 26 which is integral with channel 2. Lip 26 serves as a paper deflector as will be described later herein. Lip 26 has ends 27 and 28 which are co-extensive with ends 5 and 6 of channel 2.

Located generally intermediate ends 27 and 28, and angularly extending in a downward direction from edge 29 of lip 26, is a stud 30. Stud 30 carries a pivot shaft 31 which in turn carries a paper aligner crank 32. Crank 32 has a downwardly extending leg 33. Legs 7 and 8 of yoke 3 extend lower than leg 33. Integral with crank 32 and below pivot 31 are a supporting rib 34 and a flared paper aligner support 35. Crank 32 is biased in a clockwise direction by spring 36. Spring 36 is anchored to the underside of channel 2 and to crank 32 below pivot 31. Support 35 has a stepped extension 37 making up a portion of the paper aligner 45.

Figure 2:
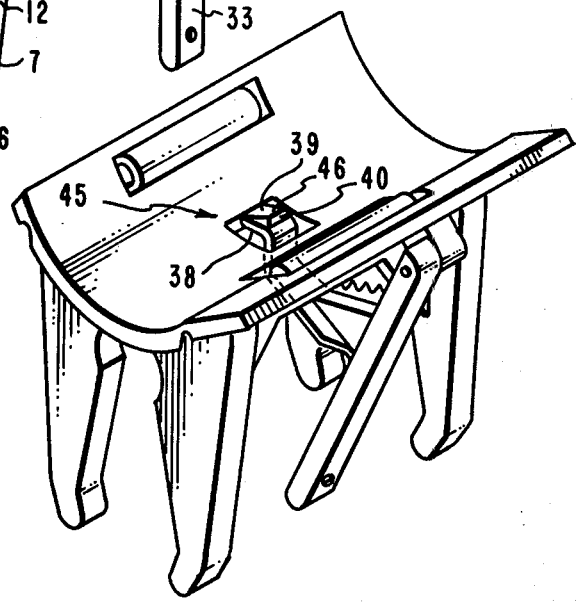
FIG. 2 is a perspective view of the apparatus of this invention with the paper aligner positioned for aligning a new sheet of paper.

Referring specifically to FIG. 2, end 38 of extension 37 carries an integral wedge 39 having an abutting face 40, and top edge 46. Top edge 46 is for engaging platen 42 (FIG. 3) to provide an obstructed paper path about platen 42 during an initial loading operation when an inserted sheet of paper is to be aligned.

The structure thus described is embodied in a single module which can be used alone or in combination with other identical modules for facilitating the feeding of paper about a platen.

Refer next to FIG. 3. Shown are a number of the modules described above rotatably carried and positioned on shaft 41. Shaft 41 is mounted to a printer frame (not shown) and is located parallel to and below platen 42. Platen 42 is positioned within channel 2, but slightly spaced therefrom. In fact, for one rotational position of apparatus 1, the only portion of apparatus 1 which can contact platen 42 is paper aligner 45. This is the release position as will be described hereinafter. Apparatus 1 can be rocked or rotated for causing engagement of rollers 23 and 24 with platen 42, but no portion of channel 2 will contact platen 42.

Each module or apparatus 1 mounted on shaft 41 is rotatable thereabout relative to platen 42 by a comb generally designated by reference numeral 50. Comb 50 is made up of a rotatable rod 51 carried by the printer frame. Rod 51 has a longitudinal slot 52 therein. Rigidly secured within slot 52 is a leaf spring which has been serrated to form a plurality of tines. The tines form the teeth of comb 50. The teeth are represented by reference numerals 53 through 58. Teeth 53 through 55 form a first grouping and teeth 56 through 58 form a second grouping. The outer teeth 53 and 55 of the first grouping and 56 and 58 of the second grouping are for cooperating with yokes 3 and 4 of each illustrated apparatus 1. The middle teeth 54 and 57 of each grouping are for cooperating with legs 33 of each illustrated apparatus 1. The relationship between teeth 53 through 58, and yokes 3 and 4 and legs 33 will be described in greater detail later herein. Wrapped about platen 42 is a sheet of paper 60 interposed between apparatus 1 and platen 42. The leading end 61 of paper 60 is disposed under a paper bail 62 and ready for printing. Paper bail 62 is spring loaded and biases leading end 61 into engagement with platen 42.

Specific Operational Description

Figure 4:
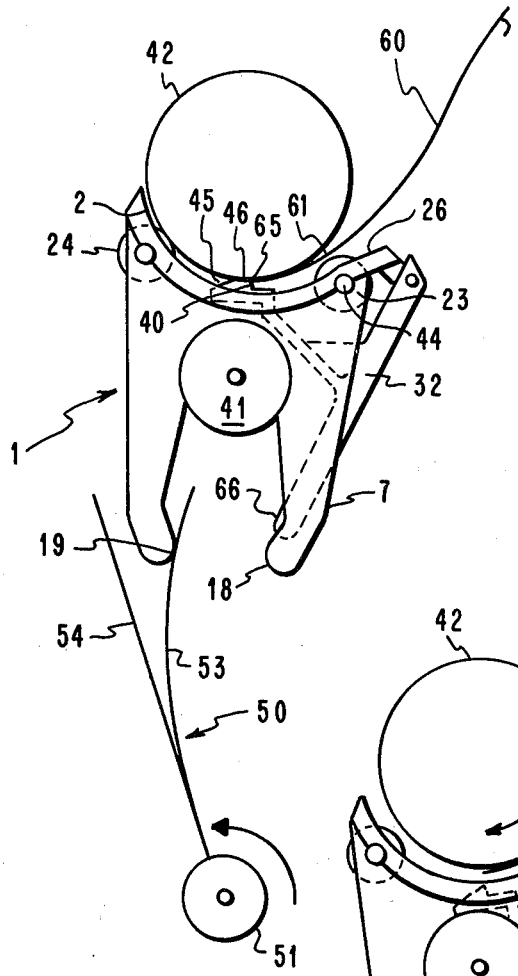
FIG. 4 is a left end view of the structure illustrated in FIG. 3 with the apparatus of this invention positioned for accepting and aligning a new sheet of paper.
Figure 5:
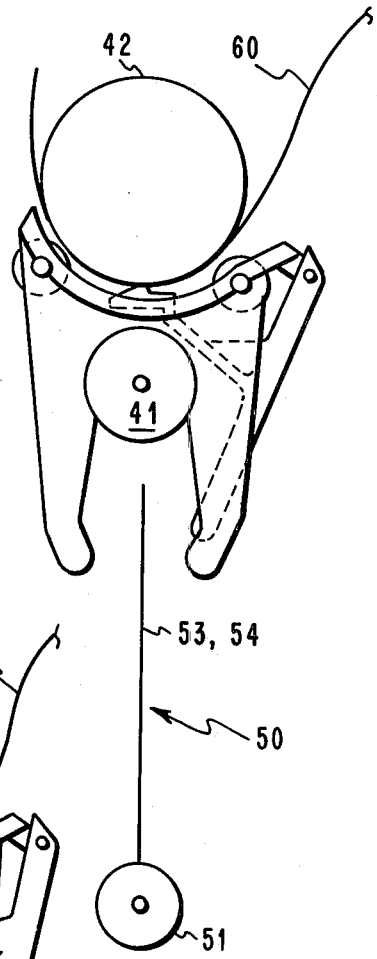
FIG. 5 is a left end view of the structure illustrated in FIG. 3 with the apparatus of this invention positioned such that the paper is released from feeding engagement with the platen.
Figure 6:
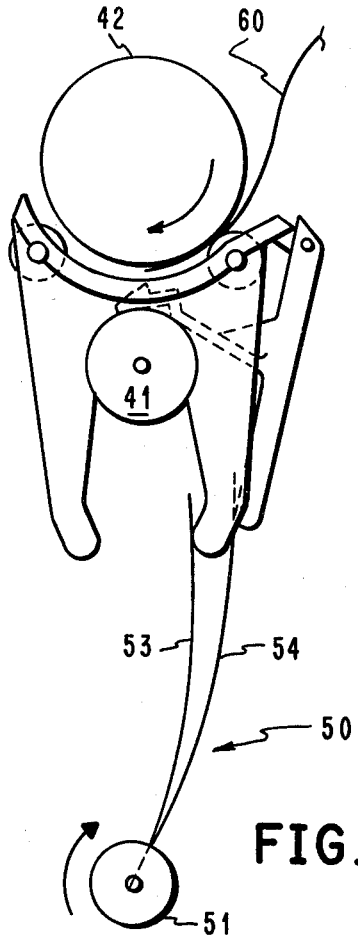
FIG. 6 is a left end view of the structure illustrated in FIG. 3 with the apparatus of this invention positioned for feeding paper about the platen following alignment of the paper.

For a detailed understanding of the operation of apparatus 1 for facilitating the feeding of paper about platen 42, reference is made to FIGS. 4, 5 and 6.

Refer first specifically to FIG. 4. At the time a new sheet of paper 60 is to be loaded into a printer for printing, the operator procedure is to insert leading edge 65 of paper 60 into the printer behind platen 42. Leading edge 65 may first contact paper deflector 26 and upon the operator applying downward force to paper 60, the leading end 61 will tend to bend toward a paper path between rear feed roller 23 and platen 42. As shown, paper deflector 26 extends into the path of leading edge 65 to guide paper 60 between rear feed roller 23 and platen 42. At this time, rear feed roller 23 must be sufficiently displaced from platen 42 to provide an unobstructed paper path between roller 23 and platen 42. Also at this time, top edge 46 of paper aligner 45 is in engagement with platen 42 to terminate the paper path between platen 42 and channel 2. Further operator insertion of paper 60 into the printer will result in leading edge 65 abutting face 40. The operator utilizes face 40 of aligner 45 for aligning paper 60. The positional relationship of roller 23 and aligner 45 relative to platen 42 results from the rotational position of comb 50. Comb 50 has been rotated in a forward or counterclockwise direction. Tooth 53 is in engagement with surface 19 and biasing apparatus 1 in the position shown. Aligner 45 is biased in the position shown by spring 36 (FIG. 1).

Following alignment of paper 60, rear feed roller 23 is to be translated toward platen 42 for causing positive engagement between platen 42 and paper 60. Prior to rotating platen 42 for feeding paper 60 between rear feed roller 23 and platen 42 and about platen 42, paper aligner 45 must be brought out of the path of leading edge 65. Also, front feed roller 24 must be out of engagement with platen 42 to provide an unobstructed path for paper 60 about platen 42.

To accomplish these chores, comb 50 upon rotation a first extent in the clockwise or reverse direction to the position shown in FIG. 5, permits front feed roller 24 to be displaced from platen 42. Rotation of comb 50 a second extent in the reverse direction results in tooth 53 contacting surface 18 of leg 7, apparatus 1 being rotated in a counterclockwise direction, roller 24 being brought out of engagement with platen 42, and roller 23 causing engagement between paper 60 and platen 42. Rotation of comb 50 a third extent in the reverse (clockwise) direction results in tooth 54 contacting surface 66 of aligner crank 32 and aligner 45 being displaced from platen 42 as shown in FIG. 6. Thereafter, platen 42 is rotated until leading edge 65 is fed beyond paper aligner 45 and front feed roller 24. After paper 60 has been fed to this extent, front feed roller 24 is to be translated toward platen 42 for providing positive engagement between platen 42 and paper 60 for continued feeding or indexing of paper 60.

For ultimately causing translation of roller 24 toward platen 42, comb 50 upon forward or counter-clockwise rotation a first extent causes tooth 54 to be brought out of engagement with surface 66. When this occurs, aligner 45 restores under the influence of spring 36 and engages paper 60 and urges it toward platen 42. With aligner 45 engaging paper 60, paper 60 will be held in an aligned position during the translation of roller 23 away from platen 42. Forward rotation of comb 50 a second extent to the position shown in FIG. 5 permits roller 23 to be translated away from platen 42. As pointed out, paper 60 is now held in place by aligner 45. Forward rotation of comb 50 a third extent causes tooth 53 to contact surface 19 and roller 24 to be translated toward platen 42 for causing driving engagement of paper 60 and platen 42. Paper 60 can now be further fed and/or indexed about platen 42 upon rotation thereof.

From the above, a number of apparatus 1 can be positioned side-by-side on rod 41 to accommodate any platen length. For example, with the distance between ends 5 and 6 being about 2.5 inches (6.25 cm) and a 13 inch (about 33 cm) platen 42 being utilized, five apparatus 1 are sufficient to obtain desired results. Each of the five can be maintained on rod 41 relative to platen 42 by using suitable spacers between the first and last apparatus 1 and the ends of the printer frame. If comb 50 has a sufficient number of teeth groupings to accommodate every apparatus 1 which can be mounted on rod 41, different length platens 42 are readily provided for by varying the number of apparatus 1 mounted on rod 41.

One desired result in paper handling is uniform feeding. Another is the ability to accept a large number of carbons. Yet another is the ability to handle different width sheets. Since each of apparatus 1 is independently carried on rod 41 and operable by different teeth groupings on comb 50, there will be a uniform loading of different width sheets of paper 60 against platen 42. The only limiting factor is the extent of rotation of comb 50. The extent of rotation of apparatus 1 in each direction is at a maximum when there is no paper between apparatus 1 and platen 42. Taking this into account in determining the required extent of rotation of comb 50, comb 50 is to be rotated sufficiently for each of the spring teeth thereof which are to act against the yoke legs 7 and 8 to provide the desired loading of paper 60 against platen 42 by rollers 23 and 24. Under these circumstances, and with the spacing between channel 2 and platen 42 being sufficient to accept a maximum number of carbons, uniform feeding will be effected.

Referring again to FIG. 5, there is shown the position of comb 50 following a paper release operation. Following printing of sheet 60, comb 50 is rotated to the position shown. Sheet 60 is thus released from driving engagement with platen 42 for substantially effortless removal of sheet 60 from the printer.

In summary an apparatus is provided for facilitating paper feeding about a printer platen, and reducing printer assembly costs. Costs are reduced since the apparatus is structured to be installed in one simple snap-on operation during printer assembly. The apparatus is comprised of a yoke and a platen channel carrying a paper aligner and feed rollers. The channel is for cooperating with the platen to deflect and guide paper when inserted into the printer and fed about the platen. The yoke is connected to the channel and has downwardly extending legs with a detent therebetween. The apparatus is rotatably positionable on a rod mounted parallel to the platen. The detent is for accepting the rod. The downwardly extending legs cooperate with a tooth on a rotatable comb to effect rotation of the apparatus about the rod. Within the channel are openings through which front and rear feed rollers carried by the channel extend. Also within the channel is an opening for accepting a positionable paper carried by the channel. The paper aligner normally extends through the aligner opening and is biased in engagement with the platen. The paper aligner has a downwardly extending leg for cooperating with another tooth on the comb. The yoke legs and aligner leg are contacted at different times by the comb teeth upon different extents and directions of rotation of the comb. At the time of initial insertion of paper into the printer from the rear of the platen, the comb must have already been rotated in a forward direction toward an operator for maintaining the rear feed roller out of engagement with the platen. When the rear feed roller is out of engagement with the platen, the front feed roller will be in engagement with the platen. Since the paper aligner will be in engagement with the platen at this time, the operator can align the leading edge of the paper against the paper aligner. Thereafter, the comb is rotated in a reverse direction. The first extent of rotation of the comb in the reverse direction permits rotation of the apparatus about the rod and translation of the front feed roller away from the platen. Continued rotation of the comb a second extent causes translation of the rear feed roller toward the platen for obtaining positive engagement between the paper and platen. Further rotation of the comb in the same direction a third extent causes the paper aligner to be withdrawn or repositioned out of the path of the paper. The paper can now be driven about the platen upon rotation of the platen. After the leading edge of the paper has been driven past the paper aligner and front feed roller to a first writing line position, the comb is again rotated in the forward direction. The first extent of forward rotation of the comb permits restoration of the paper aligner. At this time the paper aligner will be biasing the paper against the platen. This results in the paper being held in place while the rear feed roller is translated away from the platen during a second extent of forward rotation of the comb. Rotation of the comb in the forward direction a third extent results in the front feed roller being translated toward the platen. Upon engagement of the front feed roller and the paper, the paper is forced into engagement with the platen. The paper is now ready to be printed. During printing, the platen is incrementally rotated for indexing between lines to be printed.

While the invention has been particularly shown and described with reference to a particular embodiment, it will be understood by those skilled in the art that various changes in form and detail may be made without departing from the spirit and scope of the invention.

What is claimed is:

1. Apparatus for facilitating the feeding of paper about a printer platen, said apparatus comprising:

(a) yoke means for effecting rotation of said apparatus in a first and a second direction;

(b) channel means connected to said yoke means for accommodating said platen; and (c) first and second feed means carried by said channel means for selectively cooperating with said paper and said platen upon rotation of said apparatus in said first and second directions.

2. Apparatus according to claim 1 including paper aligner means carried by said channel means for cooperating with said paper and said platen independent of said rotation of said apparatus.

3. Apparatus according to claim 2 wherein said first and second feed means include feed rollers.

4. Apparatus according to claim 3 wherein said channel means includes openings through which said feed rollers extend toward said platen.

5. Apparatus according to claim 4 including an aligner opening in said channel means for accepting said aligner means which is positionable within said aligner opening.

6. Apparatus according to claim 5 including paper deflector means connected to said channel means for deflecting and guiding said paper between said platen and said channel means.

7. Apparatus according to claim 6 wherein said yoke means includes downwardly extending legs operable for effecting said rotation of said apparatus.

8. Apparatus according to claim 7 wherein said aligner means includes a downwardly extending leg for effecting positioning of said aligner means in said aligner opening relative to said platen.

9. Apparatus according to claim 8 including a detent located between said yoke legs and adjacent said channel means.

10. Apparatus according to claim 9 wherein said aligner opening is located between said feed roller openings.

* * * * *